US010550550B2

(12) United States Patent
Ismert

(10) Patent No.: US 10,550,550 B2
(45) Date of Patent: Feb. 4, 2020

(54) MODULAR TWO-PART SILLCOCK

(71) Applicant: Dominic P. Ismert, Marshall, MI (US)

(72) Inventor: Dominic P. Ismert, Marshall, MI (US)

( * ) Notice: Subject to any disclaimer, the term of this patent is extended or adjusted under 35 U.S.C. 154(b) by 107 days.

(21) Appl. No.: 15/703,960

(22) Filed: Sep. 13, 2017

(65) Prior Publication Data

US 2019/0078303 A1 Mar. 14, 2019

(51) Int. Cl.
*E03B 9/02* (2006.01)
*E03B 7/12* (2006.01)
*E03C 1/10* (2006.01)

(52) U.S. Cl.
CPC ..... *E03B 9/025* (2013.01); *E03B 7/12* (2013.01); *E03C 1/108* (2013.01); *Y10T 137/698* (2015.04); *Y10T 137/6973* (2015.04)

(58) Field of Classification Search
CPC . E03B 9/025; E03B 7/01; E03C 1/108; Y10T 137/6973
See application file for complete search history.

(56) References Cited

U.S. PATENT DOCUMENTS 3,175,575 A * 3/1965 Kennedy ..... F16K 19/00 137/360
4,022,243 A 5/1977 Edwards
4,473,244 A * 9/1984 Hill ..... E03B 7/12 137/360
4,909,270 A * 3/1990 Enterante, Sr. ..... E03B 7/10 137/107
5,590,679 A * 1/1997 Almasy ..... E03B 9/02 137/218
5,603,347 A 2/1997 Eaton
5,740,831 A 4/1998 DeNardo et al.
6,206,039 B1 * 3/2001 Shuler ..... E03B 7/12 137/360
6,394,125 B2 * 5/2002 White ..... E03B 7/10 137/301
6,668,852 B1 12/2003 Williamson
6,805,154 B1 * 10/2004 Dickey ..... E03B 7/10 137/218
6,857,442 B1 * 2/2005 Ball ..... E03B 7/10 137/301
6,857,446 B1 * 2/2005 Hoeptner, III ..... E03B 9/025 137/218

(Continued)

*Primary Examiner* — Eric Keasel
*Assistant Examiner* — Kevin R Barss
(74) *Attorney, Agent, or Firm* — Polsinelli PC

(57) ABSTRACT

A two-part sillcock includes interior and exterior sillcock members selectively coupled to actuate a valve that controls fluid flow to a faucet. The interior sillcock member includes a flanged housing having an inlet, an outlet, and a valve with a stem including a coupling at the outlet end. The coupling is supported within the housing by an adapter adjacent the outlet end. The exterior sillcock member includes a flanged faucet including a handle shaft with a coupling at the inlet end. An adapter adjacent the housing outlet supports the valve stem coupling and guides and receives the faucet handle shaft coupling for engagement of the couplings. When the exterior and interior sillcock flanges are connected, the faucet handle shaft coupling is connected with the valve stem coupling, so that movement of the handle controls operation of the valve. A dual two-part sillcock includes two sillcocks connected by a mixing assembly.

18 Claims, 8 Drawing Sheets

(56) References Cited

U.S. PATENT DOCUMENTS

| | | | | |
|---|---|---|---|---|
| 6,935,358 | B1 * | 8/2005 | Hoeptner, III | E03B 9/025 137/218 |
| 7,533,686 | B2 | 5/2009 | Brattoli et al. | |
| 8,210,199 | B2 | 7/2012 | Popp | |
| 2002/0167164 | A1 | 11/2002 | Thomas et al. | |
| 2006/0201553 | A1 * | 9/2006 | Poskin | E03B 7/10 137/360 |
| 2007/0039660 | A1 | 2/2007 | Hickman | |
| 2007/0193636 | A1 * | 8/2007 | Brady | E03B 7/12 137/606 |
| 2007/0246675 | A1 | 10/2007 | Pearson | |
| 2009/0288716 | A1 | 11/2009 | Brattoli et al. | |
| 2013/0056088 | A1 | 3/2013 | Grisham | |
| 2015/0240460 | A1 * | 8/2015 | Ball | E03B 9/10 137/296 |
| 2016/0258141 | A1 * | 9/2016 | Stanaland | E03B 9/025 |

* cited by examiner

MODULAR TWO-PART SILLCOCK

FIELD

The present disclosure relates generally to fluid handling devices associated with the wall of a building, and in particular, to a two-part sillcock.

BACKGROUND

Outdoor water faucets mounted on or adjacent the walls of buildings at approximately sill-height are commonly known as sillcocks, hose bibs or bibbs, spigots, garden valves, wall hydrants and a the like. For purposes of this disclosure, the term "sillcock" will refer to any suitable fluid handling device that may be used to implement the disclosed structures and methods.

Sillcocks are typically installed on an exterior wall at or near the sill of a home or other building to provide a threaded connection for a hose or a spout for filling a watering can. Conventional sillcocks include a faucet body having an inlet, an outlet or spout, and a flow control valve operably connected to a valve stem worked by a handle or key. In colder climates, frostproof sillcocks are commonly employed, in which the sillcock inlet end is connected to an elongate inlet pipe that extends through the foundation sill into the warmer building interior, where it is connected to a building supply pipe. The fluid control valve is positioned at the interior end of the inlet pipe and the valve stem is sized to extend from the faucet handle to the interior control valve.

In new construction, rough plumbing must be installed early, while the walls and floors remain. While it is common to temporarily cap kitchen and bathroom water supply lines to await the installation of cabinets and sinks, it is more efficient to install the exterior sillcocks as soon as the water supply lines are in place. However, sillcocks installed while a building is still under construction are vulnerable to damage by inadvertent impact from tools, equipment, and construction materials during the installation of sheathing, siding, brick or stonework, decking, concrete or stonework patios and walkways, and foundation landscaping. They may also be fouled by viscid materials such as mortar, concrete and paint. When this occurs, the entire sillcock assembly may need to be removed and replaced.

Both during and after construction, buildings and homes are frequently left unattended for extended periods of time during which the water may be turned on without permission of the owner. Even when a building or home is occupied, sillcocks are generally not visible from the inside because of their location on the exterior at or adjacent the top of the sill. In commercial and industrial applications, attempts have been made to address this by the use of a "loose key" assembly, in which a special tool is required to operate the faucet. In one example, a cylinder with a coaxial square peg is substituted for the sillcock handle. A key having a square socket may be inserted over the peg to open and close the faucet, and removed when not in use. This solution has also been employed by homeowners adjacent beach areas to prevent passers-by from using the home sillcocks for rinsing sand from their feet. Some homeowners curtail this practice by removing the sillcock handles. While effective, both loose keys and handle removal can lead to the loss of the key or handle required needed to operate the sillcock. Attempts have been made to equip conventional sillcocks with friction-fit nipples that can be screwed into the sillcock, inserted inside the building water supply pipe, and held in place by bolts. Such nipples do not protect the water supply pipe from freezing and rupture, and subsequent removal of the sillcock requires access to the interior of the building and disruption of the water supply.

Thus, there is a need for a frostproof sillcock having a faucet body that can be selectively removed from the exterior of a building and disengaged from a fluid control valve that remains in place in the interior of the building, and that can be reinstalled, all of which can be accomplished easily from the exterior of a building, without the need for access to the building water supply pipe or disruption of the water supply to the sillcock valve.

SUMMARY

A two-part sillcock in accordance with the present disclosure includes a first or interior sillcock assembly and a second or exterior sillcock assembly. The sillcock assemblies are operably and releasably coupled to one another to actuate the flow control assembly of a faucet. The interior sillcock assembly includes a housing that is generally installed within the interior of a building. The housing includes a fluid inlet and a fluid outlet, with a flow channel therebetween. A fluid flow control assembly including a valve is disposed within the housing and a control rod or stem is operably connected with the valve. A key structure is connected with the faucet end of the valve stem. An adapter is disposed adjacent the fluid outlet and includes a protective socket configured to support the valve stem key. A first coupling assembly includes a first flange that is connected to the housing for securing the interior sillcock assembly within a wall with the adapter socket and valve stem key accessible from outside the building for connection with corresponding members of a second coupling assembly. The exterior sillcock member includes a faucet body having an O-ringed inlet shank with a fluid inlet, a spout with a fluid outlet and a flow channel therebetween. A handle is operably connected with a handle shaft terminating at the inboard end in a socket for receiving the valve stem key. A second coupling assembly includes a faucet flange fitting that engages the O-ringed faucet shank containing the projecting handle shaft. When the second coupling assembly is connected to the first coupling assembly, the adapter socket receives the faucet handle shaft socket, the faucet handle shaft socket receives the valve stem key, and the faucet handle shaft operably engages the valve stem so that movement of the handle controls operation of the valve to deliver or stop the outward flow of water from a pipe inside the building through the faucet spout. Connection of the second coupling assembly to the first coupling assembly also secures the exterior sillcock member to the exterior of the building.

In another embodiment, a mixing assembly interconnects a pair of two part sillcock assemblies to provide temperature control of the outflow from a common spout. The mixing assembly includes a mixer pipe and a pair of O-ring mixer inlet stubs that are sealingly received within the respective sillcock faucet spouts so that the sealed fittings will not disconnect under normal pressure of a fluid or air flowing through the assemblies. A threaded connector attached to each inlet stub protects the O-rings and engages the respective external faucet threads.

BRIEF DESCRIPTION OF THE DRAWINGS

The foregoing and other objects, features and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION

Figure 1:
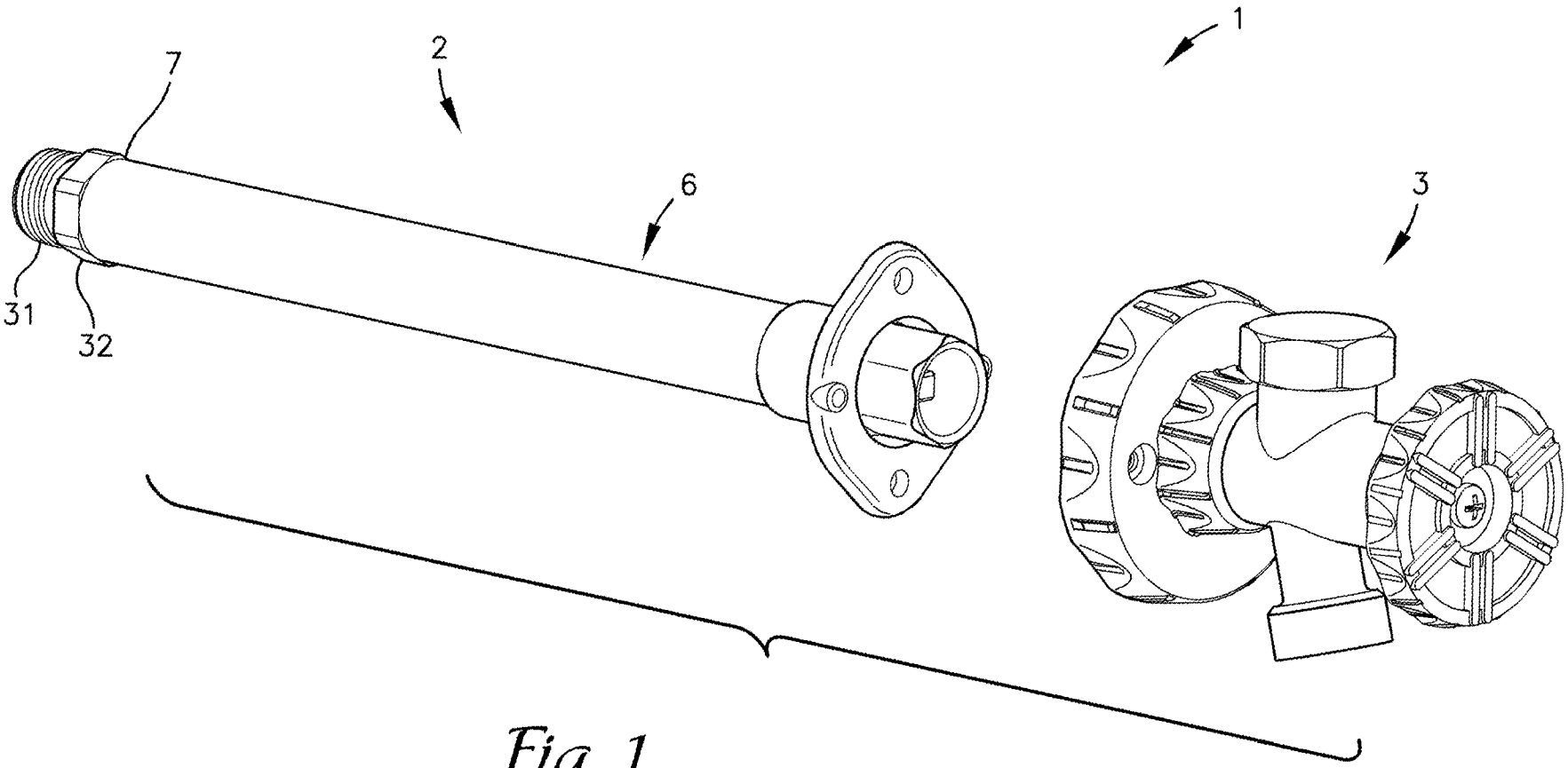
FIG. 1 is a perspective view taken from the side of a an exemplary two-part sillcock with the two parts disengaged.
Figure 2:
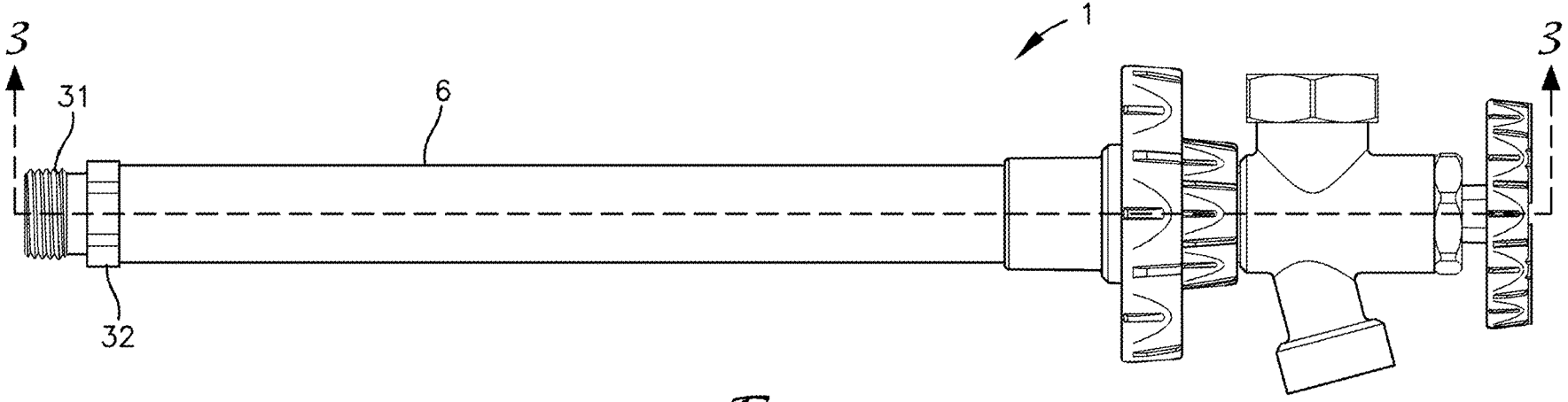
FIG. 2 is a side elevational view of the sillcock of FIG. 1 with the two parts engaged.
Figure 3:
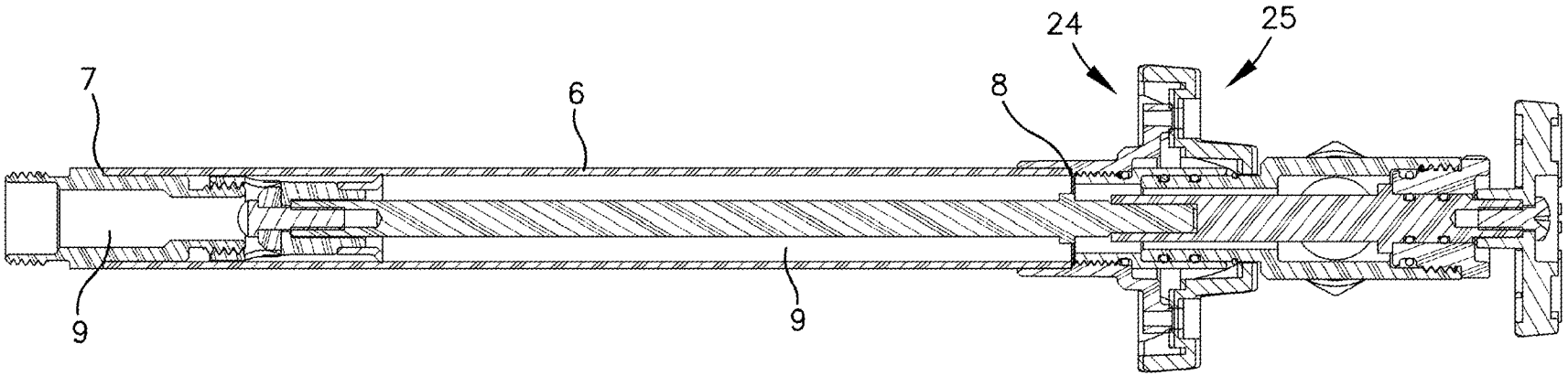
FIG. 3 is a sectional view taken along line 3-3 of FIG. 2
Figure 8:
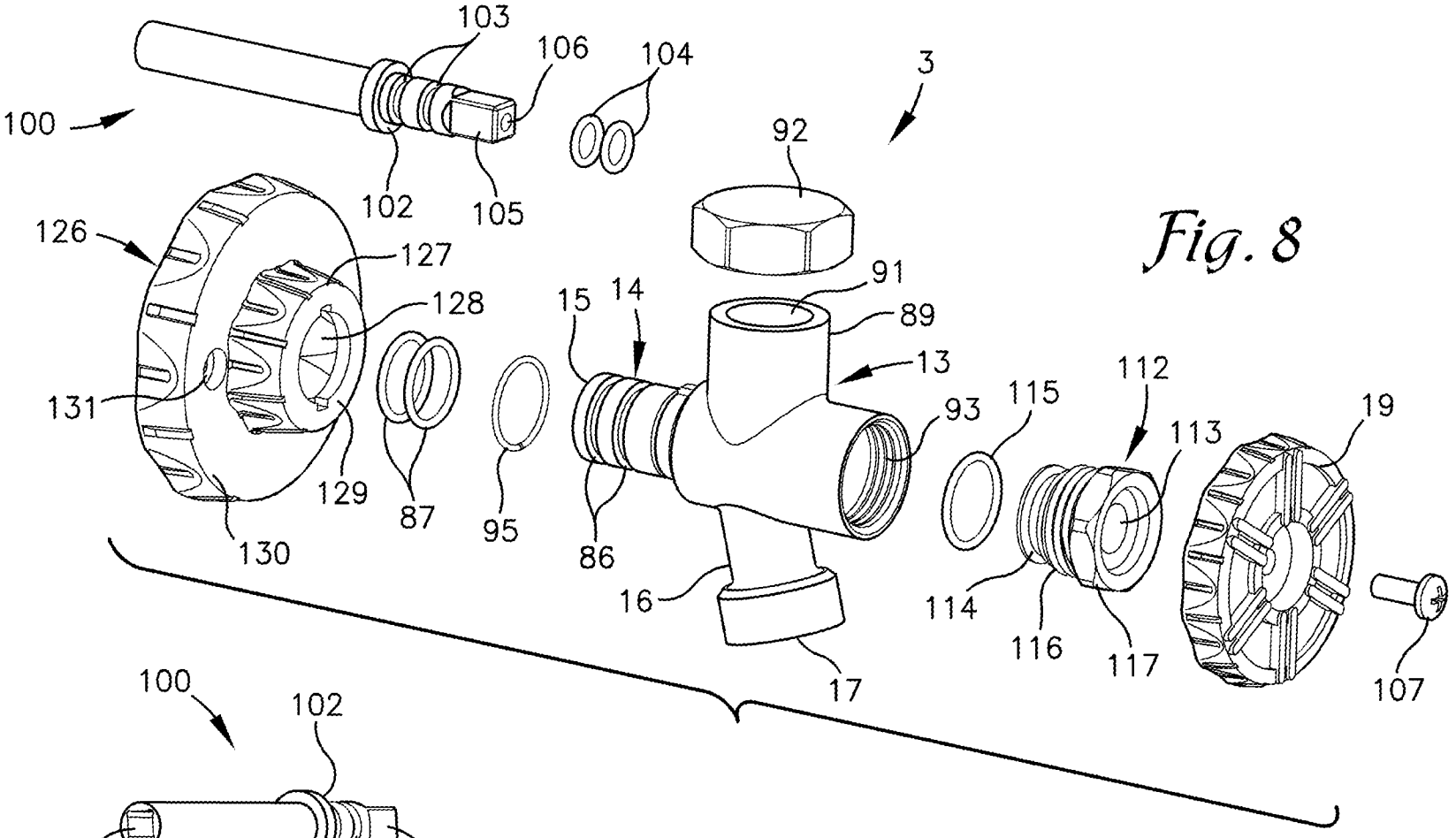
FIG. 8 is an exploded view of the second sillcock assembly shown in FIG. 1.

Referring now to the drawings, a two-part frostproof sillcock 1, in accordance with the present disclosure is illustrated in FIGS. 1-3 to include first and second sillcock assemblies 2 and 3. The first or interior sillcock assembly 2 includes an elongate tubular housing 6 for insertion through an exterior wall and into the interior space of a building. The housing includes an inlet end 7 for mounting a fitting for connection with an interior water supply pipe, and an outlet end 8 for mounting fittings for connection with the second sillcock assembly, with a fluid flow channel 9 therebetween. The second or exterior sillcock assembly 3 includes a faucet body 13 (FIG. 8) having an inlet shank 14 with an inlet 15, a spout 16 with an outlet 17, a flow channel 18 between the inlet and the outlet, and a handle 19.

A first releasable coupling assembly 24 of the first sillcock assembly 2 (FIGS. 4 and 5) operably connects the outlet end 8 of the housing to the inlet shank 14 of the second sillcock assembly 3 and secures the housing 6 to the outer wall of a building. A second releasable coupling assembly 25 of the second sillcock assembly 3 (FIG. 8) operably connects the inlet shank 14 of the second sillcock assembly to the outlet end 8 of the first sillcock assembly. When the first and second coupling assemblies 24 and 25 are connected to each other, the two fluid flow channels 9 and 18 form a continuous fluid flow channel. Mutual engagement of the first and second coupling assemblies 24 and 25 also serves to operably connect the faucet handle 19 with a fluid flow control assembly 28 within the housing for controlling the flow of fluid through the continuous fluid flow channel.

The first or interior sillcock assembly 2 is shown in more detail in FIGS. 3-7. The generally cylindrical or tubular housing 6 contains the fluid flow control assembly 28, which has a first or inlet fitting 29 and a second or valve fitting 30. The inlet fitting 29 is a hollow, generally tubular structure including a supply side hex nipple equipped with external MIP mount threads 31 in the inlet side and a hex portion 32 adjacent the outlet side. The threads 31 enable the housing to be connected with a threaded water supply pipe, such as an iron pipe in the interior of a building. In some embodiments, the MIP threads may be omitted and the connection may be made by a soldered or brazed joint adjacent the housing inlet 7 to connect with a copper or brass supply pipe. In other embodiments, an adapter may be substituted for the MIP threads 31 for connection with flexible supply piping formed from a polymer such as cross linked polyethylene or PEX tubing.

The hex area 32 provides faceted gripping surfaces for engagement by a wrench or the like in making up the connection. The midsection portion 33 of the fitting adjacent the hex area is generally cylindrical with an unthreaded outer circumference that is sized for close reception within the housing channel 9. The inlet fitting midsection 33 is fixedly attached to the inner surface of the housing 6 by conventional welding, brazing, solvent weld or any other suitable means. (FIG. 7) The delivery side of the inlet fitting includes a threaded nipple 34 having external threads that engage corresponding threading on the valve fitting 30. The nipple 34 terminates in a generally circular fluid delivery outlet that serves as a valve seat 35 for the valve fitting 30.

Figure 4:
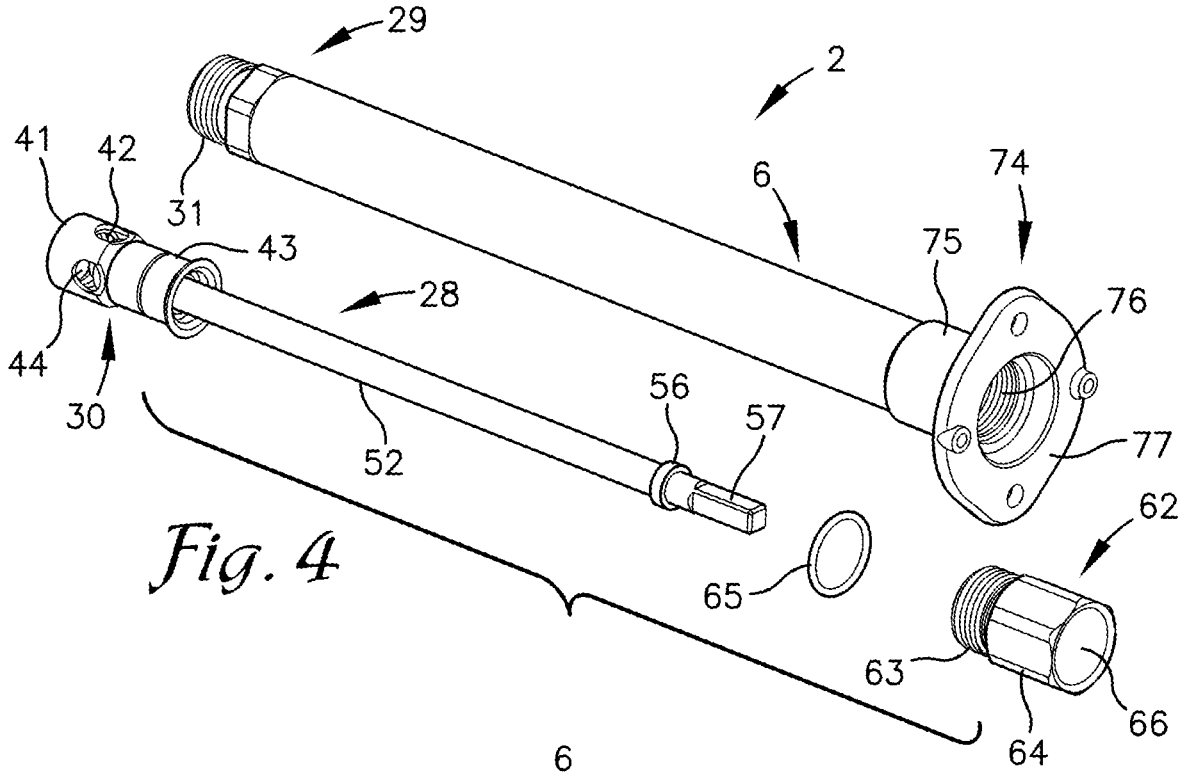
FIG. 4 is an exploded perspective view of the first sillcock assembly.
Figure 6:
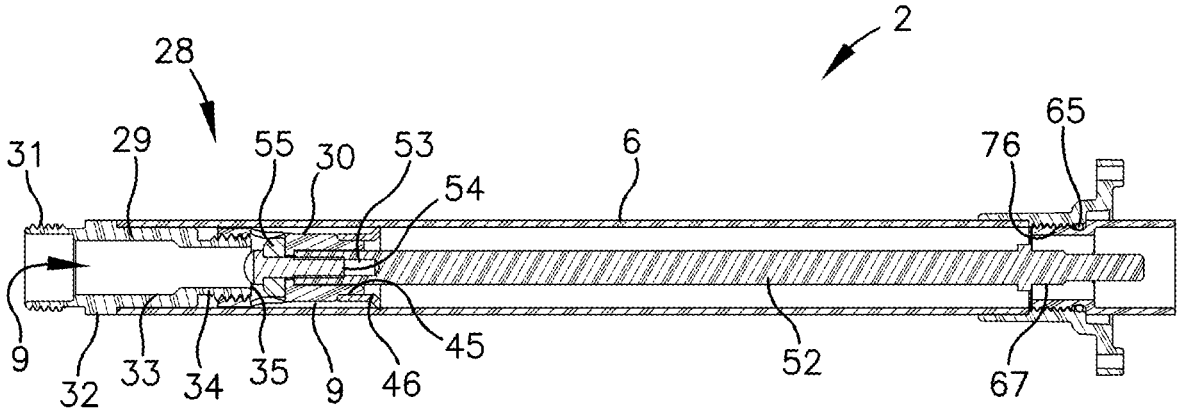
FIG. 6 is a partial sectional view taken along line 3-3 of FIG. 2 with the second sillcock assembly omitted to show details of the first sillcock assembly.
Figure 7:
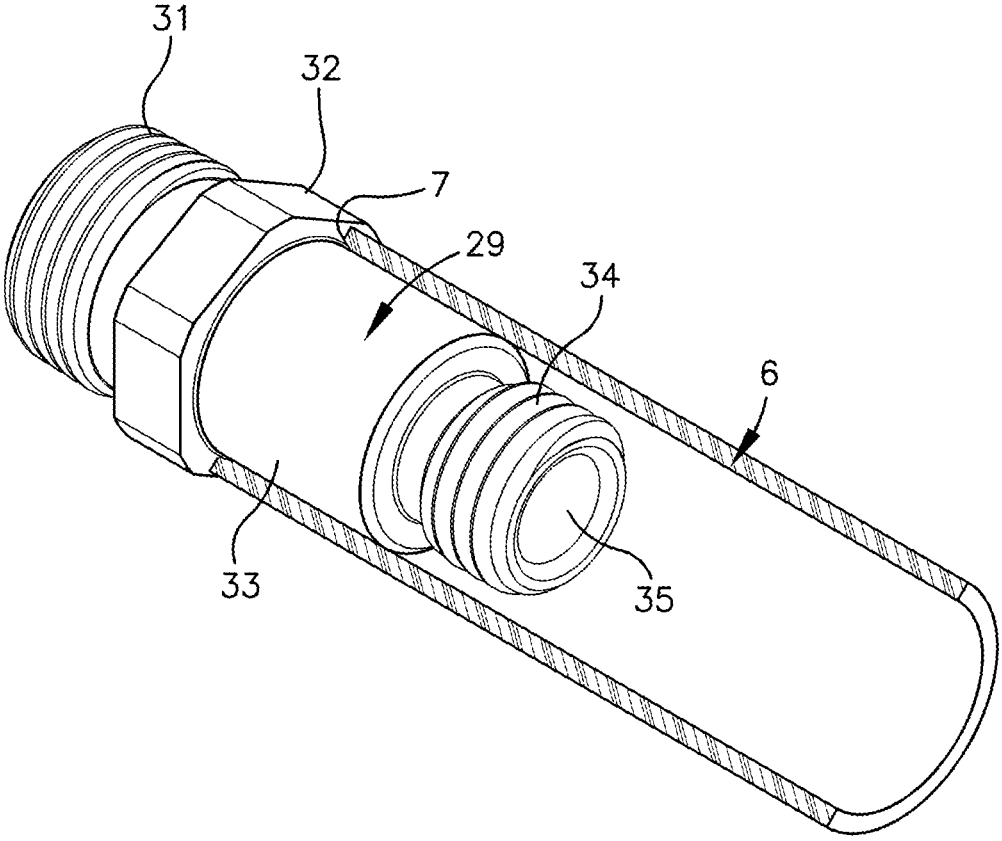
FIG. 7 is an enlarged view of the inlet end of the housing shown in FIG. 6 with parts broken away to show the inlet fitting.

As best shown in FIGS. 4 and 6, the valve fitting 30 has a generally stepped cylindrical shape, including a first or inflow portion 41 having internal threading 42 adjacent the end for mating engagement with the externally threaded delivery nipple 34. The circumference of the second or outlet portion 43 of the valve fitting is stepped in or down to allow continuation of the central flow channel 9 through a series of spaced apart apertures or ports 44 that allow water to flow from the building supply pipe into the housing when the valve is unseated, and into the channel 9 that continues between the outer perimeter of the valve fitting 30 and the inner surface of the housing 6. The end of the outlet portion is further stepped in or down to form a seat 45 for a seal 46, such as an overmolded seal 46, on the outlet end of the valve fitting 30. The seal 46 prevents backflow when the valve is closed.

An elongated valve rod, shaft, or stem 52 is connected at one end to the valve fitting 30, which is apertured to receive the stem. The inlet or sealing end of the stem includes a threaded bore 53 for receiving a seat screw 54 that holds in place a seat packing or washer 55 that seals against the valve seat 35 and the inner surface of the valve fitting 30. The flow control assembly 28 is described and drawn as a screw-down tap assembly having a flexible washer that may be selectively urged against the valve seat to regulate fluid flow through the sillcock using a screwing movement of a valve stem. However, any suitable type of fluid control device suitable for regulating the flow of water through the sillcock 1 may be employed without departing from the spirit and scope of the present disclosure. Some exemplary types of valves that may be employed in various embodiments of the disclosure include, but are not limited to, gate, needle, ball, plug, butterfly, globe, diaphragm, O-ring, and pinch valves. Any suitable drive mechanism may also be used to operate the valve, including, but not limited to, a socket, key, cam, plate with pins, or magnet. The drive mechanism may actuate a valve stem as described and shown, or it may be used to actuate a cable or any other suitable connector between the valve and the drive mechanism.

Figure 5:
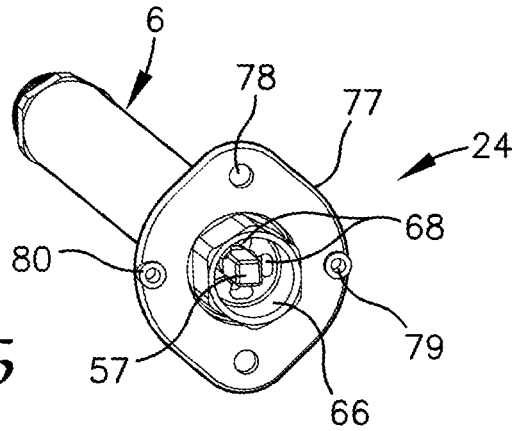
FIG. 5 is a perspective view of a first coupling assembly of the first sillcock assembly.

A radially expanded valve stem bearing member 56 is positioned in spaced relation to the outlet end of the valve stem 52. The outlet end of the valve stem 52 includes a key portion 57 having a square or otherwise non-cylindrical shaped cross section. The portion of the valve stem on the outlet side of the bearing 42 is supported within the tubular housing 6 by a sleeve or adapter 62. As best shown in FIGS. 4 and 5, the adapter 62 includes a threaded portion 63 on the valve side and a hex head 64 on the outlet side, with a relieved seat between. The seat receives a gasket such as an O-ring seal 65 that seals the interface between the adapter 62 and the tubular sidewall of the housing (FIG. 6). The hex head 64 includes an enlarged axial bore that is sized to form a socket 66 for reception of parts of the exterior sillcock assembly. The threaded portion 63 includes a smaller, square or non-cylindrical axial bore or socket 67 (FIG. 6) that is configured to receive the square or non-cylindrical key portion 57 of the valve stem. The threaded portion is also includes a plurality of spaced-apart axial flues 68 for allowing passage of fluid from the housing flow channel 9 and out through the cylindrical bore 66 when the adapter 62 is positioned over the valve stem 52 and the valve 30 is opened.

The outlet end 8 of the housing 6 is fixedly connected to a flanged fitting such as a weld neck flange 74. The weld neck flange 74 includes a neck portion or weldment 75 equipped with internal threading 76 connected with a radially expanded flange 77 having two pairs of apertures 78 and 79 for receiving fasteners, such as screws or bolts 80. The apertures 78 are sized for receiving fasteners suitable for connecting the flange 77 to the wall of a building to secure the interior sillcock assembly in place. The Apertures 79 are sized to receive fasteners suitable for removably connecting the interior and exterior sillcock assemblies 2 and 3. When the interior sillcock assembly is made up, the threaded portion 63 of the adapter engages the internal threading 76 of the flange 74 and the seal 65 engages the tubular sidewall of the housing. In another aspect, the adapter 62 and flange 74 are fixedly connected or of unitary construction, with the internal threading 76 of the flange and the external threading 63 of the adapter omitted. As best shown in FIG. 5, the weldneck flange 74, adapter 62, including the adapter sockets 66 and 67, and valve stem key 57, cooperatively form a first releasable coupling assembly 24, with the adapter socket 67 receiving the valve stem key 57, the adapter socket 66 also receiving and serving to protect the valve stem key 57 as well as to guide, receive, and releasably connect corresponding structures of the second coupling 25 of the exterior sillcock assembly 3

The second or exterior sillcock assembly 3 is shown in FIGS. 8-11. The faucet body 13 includes an inlet shank 14 having a pair of spaced apart grooves 86 adjacent the inlet 15 for receiving a pair of seals, such as O-rings 87. An additional groove 94 is positioned in outboard spaced relation to the grooves 86 for reception of a faucet flange retaining ring 95. The spout 16 extends from the lower portion of the faucet body, and may include external threading 88 (FIG. 13) for attachment of a hose. The spout 16 may be downwardly angled as shown, or it may be orthogonal to the faucet body, or it may be positioned on the front of the faucet body, with the faucet handle 19 positioned at the top. The faucet handle may be in the form of a handle wheel as shown in FIG. 1, or it may be a lever, knob, or any other configuration suitable for gripping by a user. The faucet body 13 extends upwardly to form a vacuum breaker body 89 that includes an internal channel 90 in communication with the main faucet flow channel 18. The vacuum breaker channel outlet 91 is normally covered by a cover or cap 92. The internal channel 90 of the vacuum breaker body 89 is equipped with a vacuum breaker/backflow preventer assembly (not shown) that prevents siphoning or backflow of water from a connected hose into the water supply lines of the building. The handle end of the faucet body includes internal threading 93 to receive a handle shaft bearing to be described.

Figure 9:
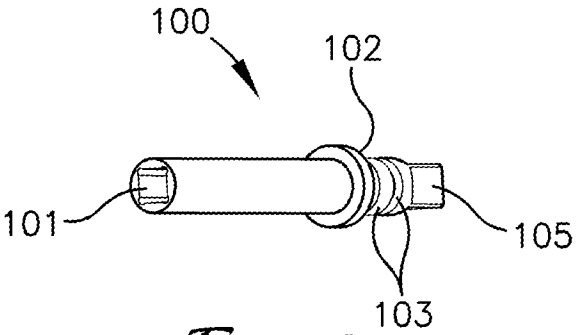
FIG. 9 is an enlarged perspective view taken from the rear to show details of the faucet handle coupling of FIG. 8.
Figure 10:
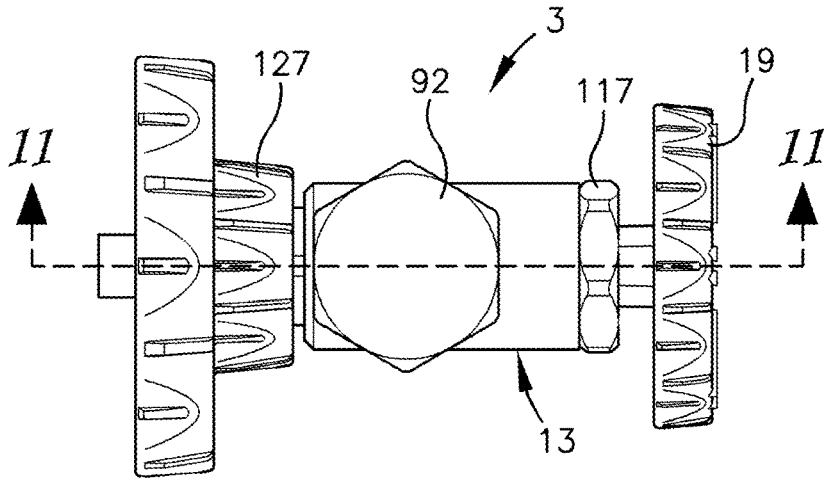
FIG. 10 is a top plan view of the second sillcock assembly shown in FIG. 1.
Figure 11:
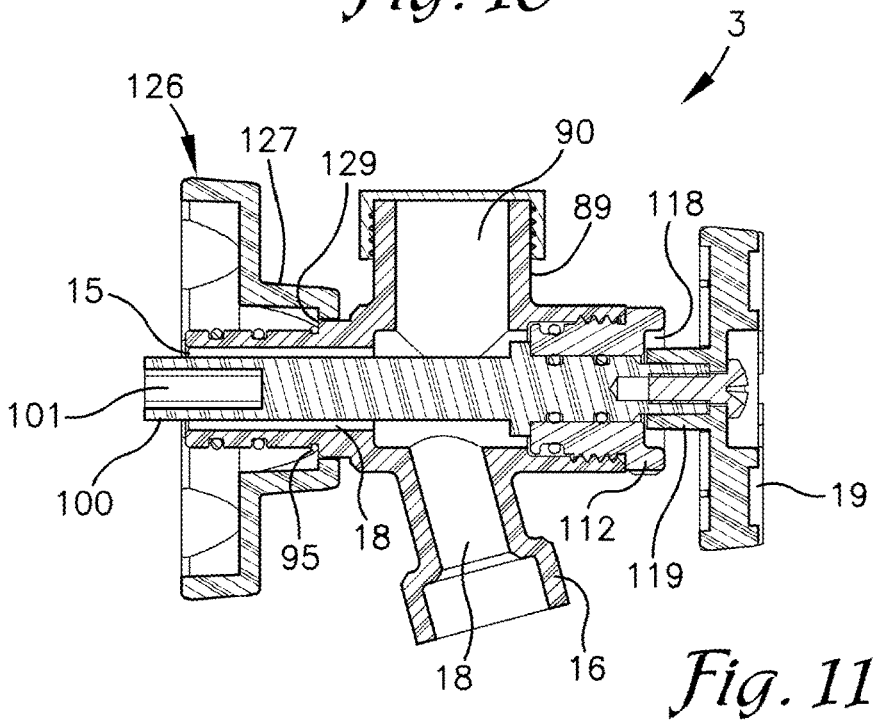
FIG. 11 is a sectional view taken along line 11-11 of FIG. 10.

A faucet handle shaft 100 extends through the faucet body between the inlet 15 of the faucet body and the handle 19. As best shown in FIG. 9, the inboard end of the shaft includes a square or non-circular axial bore or socket 101 that is sized and shaped to receive the non-circular key end 57 of the valve stem 52 (FIG. 5). The handle shaft is radially expanded to form a bearing surface 102 that is positioned in spaced relation to the handle end of the shaft 100, with an adjacent pair of spaced apart grooves 103 for reception of a pair of seals such as O-rings 104. The terminal end of the handle shaft is relieved to form a key 105 having a square or otherwise non-circular shaped cross section. The end of the key is bored and tapped to form a threaded bolt hole 106 for receiving a handle bolt 107.

The outboard portion of the handle shaft 100 is supported by an annular handle shaft bearing 112 having an axial bore 113 that is sized for reception of the faucet handle shaft 100 therethrough. The interface between the bore 113 and the handle shaft is sealed by the O-ring seals 104. The exterior surface of the inboard portion of the handle shaft bearing 112 includes a groove 114 for receiving a seal 115 such as an O-ring. The midsection of the bearing 112 includes external threading 116 for mating engagement with the internal threading 93 of the faucet body handle end. The outboard end of the bearing 112 includes a faceted head 117 such as a hex head for gripping by a wrench or the like. The head 117 is axially relieved about the outer opening of the bore 113 (FIG. 11) to provide a recess 118 for receiving the heel 119 of the handle 19.

The inlet shank 14 of the faucet body 13 is removably connected to a faucet flange fitting 126 having a neck portion 127 sized for reception of the adapter sleeve 62 of the first sillcock assembly 2. The neck 127 includes a central aperture 128 that is sized for reception of the inlet end portion of the faucet body 13, an annular shoulder 129 that is held in place by the retaining ring 95 and a radially expanded rim 130. The rim includes a pair of apertures 131 sized for receiving fasteners 132 (FIG. 13), such as screws or bolts suitable for connecting the flange fitting 126 of the exterior sillcock assembly 3 to the weldneck flange 74 of the interior sillcock assembly 2. As best shown in FIG. 3, when the exterior sillcock assembly 3 is made up, the faucet flange fitting 126, faucet body inlet shank 14, seals 87, retaining ring 95, faucet flange shoulder 129, and handle shaft key socket 101, cooperatively form a second coupling 25, with the expanded rim portion 130 of the faucet flange fitting 126 serving to protect the handle shaft seals 104 and the outboard portion of the key socket 101 of the handle shaft to connect with corresponding structures of the first sillcock assembly.

When the first and second couplings 24 and 25 are engaged, the seals 87 of the faucet inlet shank 14 of the second sillcock assembly contact the inner surface of the adapter socket 66 of the first sillcock assembly for sealing engagement, and the faucet flange retaining ring 95 contacts the internal 129 of the faucet flange neck 127, to prevent the faucet flange fitting from being pulled from the faucet inlet shank 14.

Figure 12:
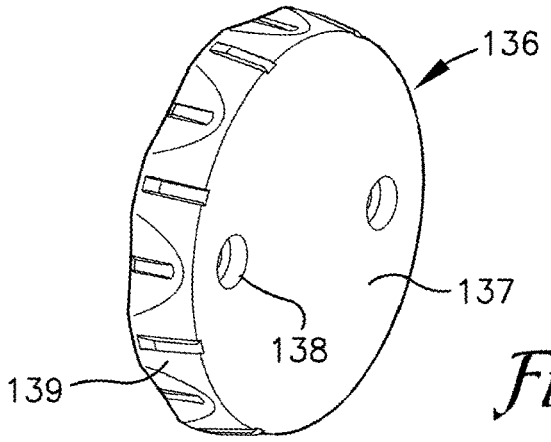
FIG. 12 is a perspective view of a cover for use with the first sillcock assembly of FIG. 1 after disengagement of the second sillcock assembly of FIG. 1.

A cover or cap 136 (FIG. 12) may be releasably mounted to the external flange 77 of the interior sillcock 2 for protecting the exposed parts of the first sillcock assembly 2 when the exterior sillcock assembly 3 is removed. The cap also serves to provide a finished appearance to the interior sillcock. The cap includes a normally outward-facing end plate 137 including a pair of small apertures 138 for receiving fasteners 80 to connect the cap to the connector apertures 79 of the interior sillcock 2. The end plate is connected to a skirt 139 that is sized to provide sufficient clearance within the cap to receive and protect the parts of the interior sillcock assembly that project beyond the first flange 74. In one embodiment, the cap 136 may be provided with a layer of a suitable thermal insulating material disposed on the inner surface to protect the first sillcock member from freezing weather.

Figure 13:
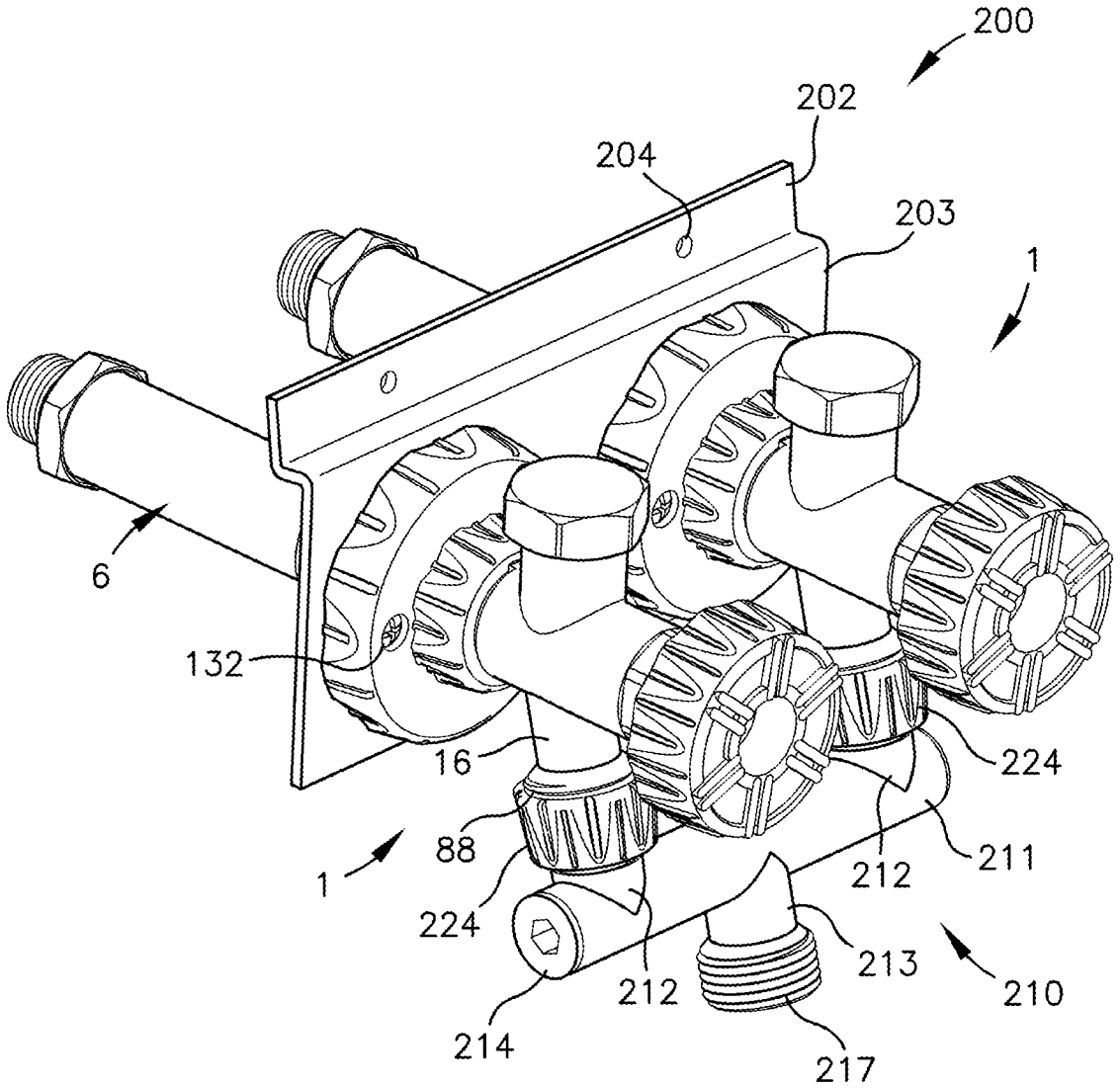
FIG. 13 is a perspective view taken from the side of an exemplary dual two-part sillcock.
Figure 15:
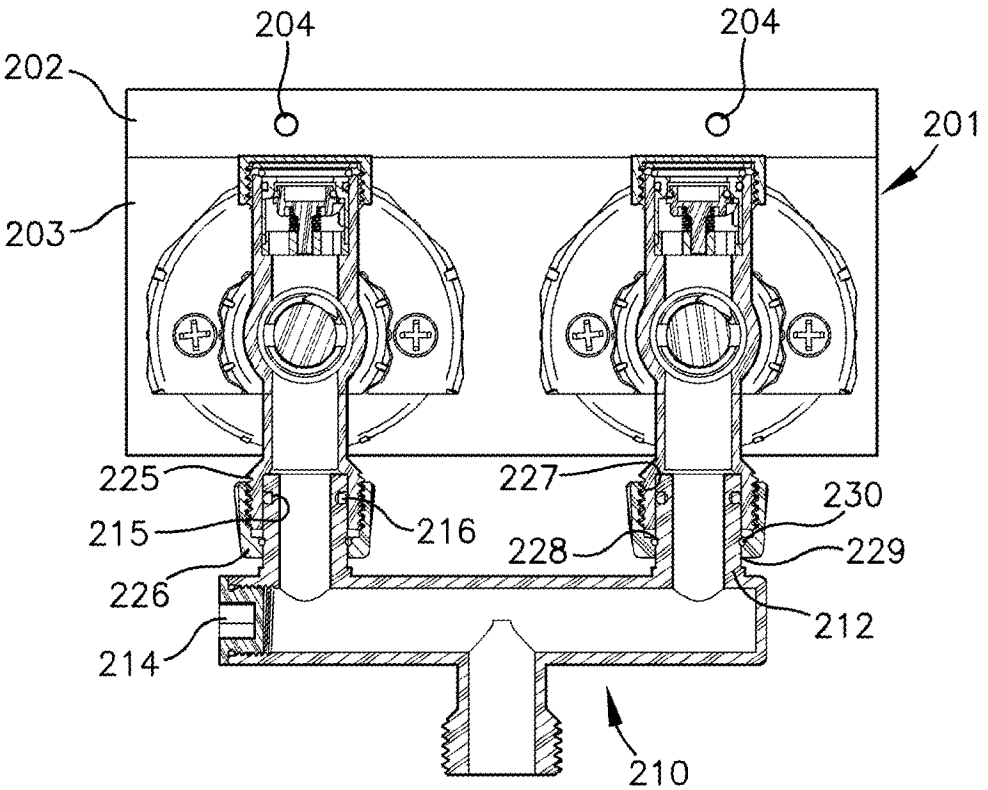
FIG. 15 is a sectional view take along lines 15-15 of FIG. 14.
Figure 14:
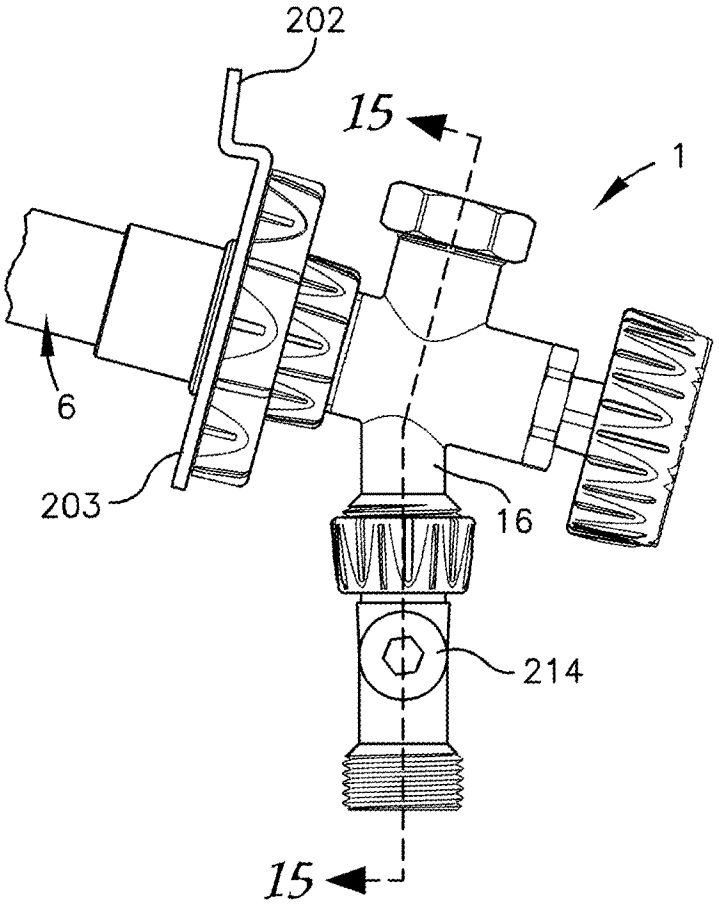
FIG. 14 is a side elevational view of the dual two-part sillcock of FIG. 13.

An exemplary mixing two-part sillcock embodiment is shown in FIGS. 13-15 and is generally designated by the reference numeral 200. This embodiment includes a pair of two-part sillcocks 1 mounted on a backplate 201. The backplate includes a slightly recessed upper mounting flange portion 202 and a lower body portion 203. The mounting flange 202 is equipped with a pair of spaced apertures 204 for receiving fasteners used to attach the sillcocks 1 to an exterior wall. As best shown in FIG. 14, the body 203 is angled rearwardly toward the wall to allow the frostproof sillcocks 1 to be mounted at a slight downward angle to allow any water accumulated within the housing 6 to drain outwardly, thereby preventing freezing and rupture of the sillcock. The backplate 201 includes a pair of apertures (not shown) that are sized for reception of the adapter 62 of the inner assembly 2 and the interconnected faucet inlet shank 14.

The faucet spouts 16 are interconnected by a mixing assembly 210 including a mixing pipe 211 that is sized to extend between the faucet spouts 16, a pair of normally upstanding, inlet stubs 212 and a spout 213. The mixer pipe is open at one end, which is equipped with a removable plug 214 to enable cleanout of the interior of the pipe, for example to remove accumulated sediment. As best shown in FIG. 15, the inlet stubs 212 each include an external groove 215 for reception of a seal 216, such as an O-ring for sealing the external surface of the inlet stub 212 against the inner surface of the faucet spout 16. The spout 213 is positioned to depend between the inlet stubs 212 and includes external threads 217 for attachment of a hose or the like.

The Mixing assembly 210 includes a pair of connectors 224, each having a first or faucet end 225 and a second or connector end 226. The inner surface of the faucet end 225 includes threading 227 for mating engagement with external threads 88 on the faucet spouts when the inlet stubs are inserted into the faucet spouts. The second end is axially curved to form an internal shoulder 228. An adjacent groove 229 receives a retaining ring 230 that encircles a respective inlet stub 212. The shoulder 228 of the second end 226 prevents the connector 224 from being pulled from the faucet inlet shank 14.

The two-part sillcock 1 may be constructed of brass, iron, synthetic resin or any other suitable material. It may be provided as a unit to be assembled on site, or it may be provided as a modular assembly, with the interior sillcock assembly 2 constructed to have an inlet end 7 with fittings that correspond to the type of water supply pipe and the exterior sillcock assembly 3 constructed in accordance with the intended use. For example, the exterior sillcock may include exterior threading for use as a hose bibb, to include a handle or handle wheel, or it may be constructed of rough brass, or it may be chrome plated.

In an exemplary use, a two-part sillcock assembly 1 is installed by selecting an embodiment of an interior sillcock assembly 2 that corresponds with the type of water supply pipe (i.e., iron, copper, brass, PEX, or any other supply pipe) or using an adapter to make the connection. The housing 6 of the interior sillcock is inserted into the interior of the building through a pre-drilled hole in the sill plate or other suitable building member. The hole is predrilled to have a slight downward pitch toward the outside of the building to allow any water that remains in the housing after the valve is closed to drain outside and away from the building. The interior sillcock 2 is attached to the outer wall of the building by inserting a pair of fasteners 80 through corresponding holes 79 in the flange portion 77 of the weldneck flange 74. The inlet fitting 29 of the interior sillcock is connected to the building water supply pipe in a conventional manner. It is foreseen that connection of the interior sillcock to the building water supply pipe may be made either before or after the interior sillcock is attached to the outer wall of the building. Following installation of the interior sillcock the adapter socket 66 and valve stem key 57 within the socket will be noticed to protrude slightly beyond the flange 77.

An exterior sillcock assembly 3 may be selected from an array of exterior sillcock assemblies having various purposes of operation and/or aesthetic appearance, such as material, color, or style. In certain embodiments the array of assemblies may include spouts configured to include male hose threading for attachment to a garden hose, or spouts configured to include MIP threads for connection with a section of pipe, or an aeration cap for dispensing water directly from the sillcock 1. In other embodiments the exterior sillcock assembly may be roughly constructed from inexpensive materials such as a synthetic resin, which may be available in a variety of colors, or of more costly materials such as brass or plated brass, or it may be constructed to have a shiny, brushed or matte finish. Use of such exterior sillcock modules may provide a lower cost initial sillcock 1, which may be later upgraded to include a more costly exterior sillcock assembly 3 without the need to replace the entire sillcock 1.

The exterior sillcock 3 is positioned for insertion of the inlet shank 14 through the central aperture 128 of the faucet flange neck 127. The central aperture is equipped with a pair of opposed grooves for alignment with a pair of matching lands on the faucet body and the faucet flange 126 may be rotated to align the two. The faucet flange 126 is then snugged against the faucet body 13 until the retaining ring 95 has been captured by the shoulder 129 of the flange neck. Once the faucet flange is installed, if viewed from the inlet side, the faucet handle shaft 100 with its axial socket 101 will be noticed to protrude slightly beyond the faucet flange 126.

The exterior faucet flange 126 is then placed over the weldneck flange 77 and the respective holes aligned for reception of fasteners 132. As the respective flanges are urged together, the faucet handle shaft is received within the adapter socket 66 and the valve stem key 57 is received within the faucet handle shaft socket 101. In this manner, the faucet handle shaft socket is coupled with and may be used for turning the valve stem key 57. The faucet handle 19 that is bolted into the bolt hole 106 on the outlet side of the faucet handle shaft 100 is thus remotely coupled with and may be used to turn the valve stem 52 and rotate the valve 30 toward or away from the valve seat 35.

Advantageously, when all of the parts of the first and second coupling assemblies 24 and 25 are mutually engaged and fastened in place, the valve stem key 57 is enclosed and protected by the faucet handle shaft socket 101, both the valve stem key and the faucet handle shaft socket are enclosed and protected by the adapter socket 66, and all of the foregoing parts are enclosed by (or sandwiched between) and protected by the first flange and faucet flange fittings 74 and 126. In this manner, the operable parts of the sillcock 1 receive multiple layers of protection during operation. The first flange 74 and all parts of the first coupling assembly are also covered from view. In one embodiment, the faucet flange fitting 126 is constructed to have a finished, aesthetically pleasing surface and shape to enhance the visual appearance of the sillcock 1.

These steps may be reversed for disassembly of the exterior sillcock assembly 3 from the interior sillcock assembly 2. Once disassembly is complete, an operator may install a protective cap 136 by placing the cap over the exposed interior sillcock adapter socket 66, valve key 57, and flange 77, aligning the flange apertures 78 with the apertures 138 of the cap, and inserting fasteners 79. These steps may be reversed to remove the cap 136 from the interior sillcock.

An exemplary use of the dual two-part sillcock assembly is similar to that of the two part sillcock assembly 1, except that a pair of interior sillcocks 2 are positioned within the building and connected to respective building water supply pipes. In addition, the interior sillcock 2 flange 77 is attached to the backplate 201 rather than the exterior building wall. The backplate is captured between the weldneck and faucet flange fittings 74 and 126 and the backplate is attached to an exterior wall of the building by inserting fasteners through the apertures 204. The mixing assembly 210 with attached connectors 224 is installed by inserting the inlet stubs 212 into respective faucet spouts 16 for sealing engagement of the inlet stub inner seals 216 with the inner surfaces of the respective faucet spouts 16. Rotation of the connectors 224 engages their internal threading 227 with the faucet hose threads 88. The retaining rings 230 on the inlet stubs 212 engage the connector shoulders 228 and prevent pulling disengagement of the inlet stubs from the connectors 224. The preceding steps may be reversed for disassembly of the exterior sillcock assemblies of dual two-part sillcock assembly from the interior sillcock assemblies.

I claim:

1. A modular sillcock that controls the flow of a fluid from a supply line associated with a building, and comprising:

a first sillcock member including a housing having an inlet and an outlet, a valve disposed adjacent the housing inlet, a valve drive member operably connected to the valve, and a first releasable coupling mechanism having a housing flange connected to the housing;

a second sillcock member configured for connection with the first sillcock member, the second sillcock member including a faucet having an inlet, an outlet, a handle, and a second releasable coupling mechanism having a faucet flange connected to the faucet; and an adapter disposed adjacent the housing outlet, the adapter releasably coupled to the housing flange, wherein, when the second releasable coupling mechanism is coupled to the first releasable coupling mechanism, the handle operably engages the valve drive member so that movement of the faucet handle controls the operation of the valve.

2. The modular sillcock of claim 1, wherein:

the valve drive member includes an engagement member at an outboard end thereof;

the handle includes an engagement member at an inboard end thereof, and when the second releasable coupling mechanism is coupled to the first releasable coupling mechanism, the valve drive member engagement member engages the handle engagement member, operably engaging the handle with the valve drive member so that movement of the handle controls the operation of the valve.

3. The modular sillcock of claim 2, wherein:

the valve drive engagement member includes a key;

the handle engagement member includes a socket, and when the second releasable coupling mechanism is coupled to the first releasable coupling mechanism, the valve drive engagement member key is received within the handle engagement member socket, operably engaging the handle with the valve drive member so that movement of the handle controls the valve.

4. The modular sillcock of claim 2, wherein:

the valve drive engagement member includes a socket;

the handle engagement member includes a key, and when the second releasable coupling mechanism is coupled to the first releasable coupling mechanism, the valve drive engagement member socket receives the handle engagement member key, operably engaging the handle with the valve drive member so that movement of the handle controls the valve.

5. The modular sillcock of claim 2, wherein:

an adapter is disposed adjacent the housing outlet, the adapter configured to support the valve driver engagement member, and the adapter is configured to receive the faucet handle engagement member.

6. The modular sillcock of claim 5, wherein the valve further includes:

a seal member configured to provide a seal between an outer surface of the adapter and an inner surface of the housing; and a plurality of spaced apertures configured to allow passage of a fluid from the interior of the housing out through the adapter when the adapter supports the valve driver engagement member and the valve is in an open position.

7. A modular sillcock that controls the flow of a fluid from a supply line associated with a building, and comprising:

a first sillcock member including a housing having an inlet and an outlet connected to a housing flange, a valve disposed adjacent the housing inlet, the valve connected to a valve stem having an opposite end terminating in a valve stem coupling;

a second sillcock member configured for connection with the first sillcock member, the second sillcock member including a faucet having an inlet shank releasably connected to a faucet flange, a faucet outlet and a handle, the handle connected to a handle shaft terminating in a handle shaft coupling, the faucet inlet shank having a pair of spaced-apart circumferential seals and a faucet flange retaining ring, the faucet flange having a neck having a shoulder; and the faucet handle shaft coupling is configured to engage the valve stem coupling, and the faucet flange is configured to connect with the housing flange, wherein, when the faucet flange is connected with the housing flange, the faucet handle shaft coupling is operably connected with the valve stem coupling so that movement of the faucet handle controls the valve, the faucet flange retaining ring contacts the faucet neck shoulder and the faucet inlet shank seals contact an inside of an adapter socket in sealing relation thereby constraining the faucet flange against disengagement from the faucet inlet shank.

8. The modular sillcock of claim 7, wherein:

an adapter is disposed adjacent the housing outlet, the adapter configured to support the valve stem coupling, and the adapter is configured to receive the faucet handle shaft coupling.

9. The modular sillcock of claim 8, wherein the valve further includes a seal member for sealing between an outer surface of the adapter and an inner surface of the housing.

10. The modular sillcock of claim 8, wherein the valve further includes a plurality of spaced apertures for allowing the passage of a fluid from the interior of the housing out through the adapter socket when the adapter supports the valve stem and the valve is in an open position.

11. The modular sillcock of claim 7, wherein the housing flange is configured for attachment to the outside of a building with the housing extending inside the building.

12. The modular sillcock of claim 7, wherein the valve comprises a screw-down tap having a flexible washer that is selectively pressed against a seat to regulate flow through the sillcock using a screwing movement.

13. The modular sillcock of claim 7, further comprising a plurality of the second sillcock members, each second sillcock member having a different purpose of operation.

14. The sillcock of claim 7, further including a cap for covering the first sillcock member when the second sillcock member is disengaged.

15. The sillcock of claim 7, wherein the faucet further includes a vacuum breaker assembly.

16. A dual modular sillcock that controls the flow of fluids from a supply line associated with a building, and comprising:

a pair of first sillcock members, each member including a housing having an inlet and an outlet connected to a housing flange, a valve disposed adjacent the housing inlet, the valve connected to a valve stem having an opposite end terminating in a valve stem key, an adapter disposed adjacent the outlet, the adapter including an adapter socket configured to support the valve stem key;

a pair of second sillcock members configured for connection with a first sillcock member, each second sillcock member including a faucet having an inlet shank releasably connected to a faucet flange, a faucet outlet and a handle, the handle connected to a handle shaft terminating in a socket;

the adapter socket is configured to receive the faucet handle shaft socket, the faucet handle shaft socket is configured to receive the valve stem key, and the faucet flange is configured to connect with the housing flange;

wherein, when the faucet flange is connected with the housing flange, the faucet handle shaft is operably connected with the valve for movement of the faucet handle to control the valve;

a mounting plate having a pair of apertures for receiving a pair of first sillcock members therethrough in spaced relation for connection of a pair of second sillcock members to the first sillcock members to form a first sillcock and a second sillcock connected to the mounting plate, each sillcock including an externally threaded spout;

a mixing member for attachment to the first and second sillcocks, the mixing member including a mixer pipe having a pair of spaced inlet shanks connected to the mixer pipe and an opposed central mixing spout with an outlet, each inlet shank including a circumferential seal and a connector retaining ring; and each mixing member further including a pair of internally threaded connectors for connecting the inlet shanks with the externally threaded sillcock spouts, the connectors each including a shoulder on the outlet side, wherein, when the inlet shanks are inserted into the sillcock spouts, the retaining rings contact the connector shoulders and the inlet shank seals contact inner surfaces of the spouts in sealing relation, thereby constraining the mixing member inlet shanks against disengagement from the faucet spouts.

17. The dual modular sillcock of claim 16, wherein the mixing member further includes a clean out plug.

18. The dual modular sillcock of claim 16, further including at least one cap for covering a first sillcock member when the corresponding second sillcock member is disengaged.

* * * * *